US011078436B2

(12) United States Patent
Yang et al.

(10) Patent No.: US 11,078,436 B2
(45) Date of Patent: Aug. 3, 2021

(54) LUBRICANT FOR PREVENTING AND REMOVING CARBON DEPOSITS IN INTERNAL COMBUSTION ENGINES

(71) Applicant: Valvoline Licensing and Intellectual Property, LLC, Lexington, KY (US)

(72) Inventors: Ying Yang, Shanghai (CN); Frances E. Lockwood, Georgetown, KY (US); Daniel J. Dotson, Lexington, KY (US); Joshua Frederick, Lexington, KY (US); Jamie Daasch, Lexington, KY (US)

(73) Assignee: Valvoline Licensing and Intellectual Property LLC, Lexington, KY (US)

( * ) Notice: Subject to any disclaimer, the term of this patent is extended or adjusted under 35 U.S.C. 154(b) by 0 days.

(21) Appl. No.: 15/302,341

(22) PCT Filed: Apr. 10, 2015

(86) PCT No.: PCT/US2015/025255
§ 371 (c)(1),
(2) Date: Oct. 6, 2016

(87) PCT Pub. No.: WO2015/157606
PCT Pub. Date: Oct. 15, 2015

(65) Prior Publication Data

US 2017/0029734 A1 Feb. 2, 2017

Related U.S. Application Data

(60) Provisional application No. 61/978,488, filed on Apr. 11, 2014.

(51) Int. Cl.
*C10M 111/00* (2006.01)
*C10M 111/04* (2006.01)
(Continued)

(52) U.S. Cl.
CPC ..... *C10M 111/04* (2013.01); *C10M 111/02* (2013.01); *C10M 169/04* (2013.01);
(Continued)

(58) Field of Classification Search
CPC ..... C10M 111/04; C10M 111/02; C10M 2209/1033; C10M 2207/2825;
(Continued)

(56) References Cited

U.S. PATENT DOCUMENTS 5,177,284 A 1/1993 Le et al.
6,232,279 B1 5/2001 Steigerwald
(Continued)

FOREIGN PATENT DOCUMENTS

CN 1596294 A 3/2005
CN 103113967 A 5/2013
(Continued)

OTHER PUBLICATIONS

International Search Report & Written Opinion from corresponding PCT/US2015/025255, dated Jul. 9, 2015 (14 pages).
(Continued)

*Primary Examiner* — Taiwo Oladapo
(74) *Attorney, Agent, or Firm* — Wood Herron & Evans LLP

(57) ABSTRACT

A lubricant formulation which is effective to remove or prevent carbon deposits in internal combustion engines has a solvency as defined by aniline point from about 20 to about 115, a volatility (as measured by NOACK) of less than 15%, an oxidative stability (as measured by PDSC) of above 40 minutes and a base oil viscosity of above 2 and below 10 cSt. The lubricant formulation can be formed from a blend of Group III, IV and V lubricants, in particularly polyalphaolefins, alkylated naphthalenes and polar Group V base stocks such as polyol esters. The carbon deposits can be removed
(Continued)

from the engine piston by simply running the engine with the lubricant for one required cycle, or can be used continuously in the engine to prevent buildup.

23 Claims, 3 Drawing Sheets

(51) Int. Cl.

| | |
|---|---|
| ***C10M 169/04*** | (2006.01) |
| ***C10M 111/02*** | (2006.01) |
| *C10N 30/02* | (2006.01) |
| *C10N 30/04* | (2006.01) |
| *C10N 30/10* | (2006.01) |
| *C10N 30/12* | (2006.01) |
| *C10N 30/18* | (2006.01) |
| *C10N 30/00* | (2006.01) |
| *C10N 40/25* | (2006.01) |

(52) U.S. Cl.
CPC ..... *C10M 2203/024* (2013.01); *C10M 2203/1006* (2013.01); *C10M 2203/1025* (2013.01); *C10M 2203/1065* (2013.01); *C10M 2205/0285* (2013.01); *C10M 2205/223* (2013.01); *C10M 2207/0406* (2013.01); *C10M 2207/2805* (2013.01); *C10M 2207/2825* (2013.01); *C10M 2207/2835* (2013.01); *C10M 2209/1023* (2013.01); *C10M 2209/1033* (2013.01); *C10M 2215/064* (2013.01); *C10M 2227/061* (2013.01); *C10N 2030/02* (2013.01); *C10N 2030/04* (2013.01); *C10N 2030/10* (2013.01); *C10N 2030/12* (2013.01); *C10N 2030/18* (2013.01); *C10N 2030/52* (2020.05); *C10N 2030/70* (2020.05); *C10N 2030/74* (2020.05); *C10N 2040/25* (2013.01)

(58) Field of Classification Search
CPC .. C10M 2209/1023; C10M 2203/1025; C10M 2205/0285; C10M 2215/064; C10M 2205/223; C10M 2203/024; C10M 2203/1006; C10M 2203/1065; C10M 2207/0406; C10M 2207/2805; C10M 2207/2835; C10M 2227/061; C10M 105/06; C10M 105/38; C10M 107/02; C10M 171/02; C10N 2030/02; C10N 2030/04; C10N 2030/10; C10N 2030/12; C10N 2030/18; C10N 2030/52; C10N 2030/70; C10N 2030/74; C10N 2040/25; C10N 2020/02
See application file for complete search history.

(56) References Cited

U.S. PATENT DOCUMENTS

| | | | | |
|---|---|---|---|---|
| 8,318,643 | B2 | 11/2012 | Van Houten | |
| 8,455,416 | B2 | 6/2013 | Bagheri et al. | |
| 8,637,438 | B2 | 1/2014 | Yamada | |
| 8,703,677 | B2 | 4/2014 | Boffa et al. | |
| 9,068,134 | B2 | 6/2015 | Deckman et al. | |
| 9,127,231 | B2 | 9/2015 | Carey et al. | |
| 2004/0009881 | A1 | 1/2004 | Hessell et al. | |
| 2009/0143261 | A1* | 6/2009 | Takeoka | C10M 107/02 508/110 |
| 2009/0312205 | A1* | 12/2009 | Colbourne | C10M 105/04 508/110 |
| 2010/0075875 | A1* | 3/2010 | Yaguchi | C10M 169/04 508/192 |
| 2010/0105585 | A1* | 4/2010 | Carey | C10M 141/10 508/162 |
| 2010/0144572 | A1 | 6/2010 | Patil et al. | |
| 2011/0177989 | A1* | 7/2011 | Bouffet | C10M 169/041 508/507 |
| 2012/0283156 | A1* | 11/2012 | DiBiase | C08F 20/14 508/154 |
| 2012/0322705 | A1* | 12/2012 | Blain | C10M 169/04 508/430 |
| 2013/0090273 | A1* | 4/2013 | Martin | C10M 169/04 508/150 |
| 2013/0143783 | A1* | 6/2013 | Deckman | C10M 105/32 508/459 |

FOREIGN PATENT DOCUMENTS

| | | | |
|---|---|---|---|
| WO | 2003048276 | A1 | 6/2003 |
| WO | 2007095392 | A2 | 8/2007 |
| WO | 2008055976 | A2 | 5/2008 |

OTHER PUBLICATIONS

Govind Khemchandani: "Characteristics of New Oil Soluble Polyalkylene Glycols", Feb. 9, 2011 (Feb. 9, 2011), pp. 1-22, XP055198380, Retrieved from the Internet [retrieved on Jun. 25, 2015].

Ronald L Shubkin: "Polyalphaolefins", CRC Handbook of Lubrication and Tribology: Theory of Tribology,, Jan. 1, 1993 (Jan. 1, 1993), pp. 219-236, XP009108705.

CRC Handbook of Lubrication and Tribology vol. III Monitoring, Materials, Synthetic Lubricants and Applications by E. Richard Booser, Ph.D. dated 1994 (20 pages).

Gas to Liquids by H. Ernest Henderson, undated, (14 pages).

Chinese Office Action, Chinese Patent Application No. 201580029414A, dated Dec. 3, 2018, 11 pages.

* cited by examiner

LUBRICANT FOR PREVENTING AND REMOVING CARBON DEPOSITS IN INTERNAL COMBUSTION ENGINES

PRIORITY CLAIM

This application is a submission under 35 USC § 371 of International Application No. PCT/US2015/025,255, filed Apr. 10, 2015, which claims priority to U.S. Provisional Patent Application, Ser. No. 61/978,488, filed Apr. 11, 2014, both of which are incorporated herein by reference.

BACKGROUND OF THE INVENTION

There are three types of deposits which can form on pistons and rings: sludge, varnish and hard carbon. Hard carbon is the most difficult to remove. Over a period of time, carbon deposits can form in certain internal combustion engines, particularly on the piston lands, and in the grooves between the rings and the piston. These carbon deposits frequently manifest themselves by increased oil consumption. Carbon deposit can cause the piston rings to stick, which prevents them from forming a proper seal which allows oil into the combustion chamber and allows the combustion products into the oil. Carbon deposits between the rings and grooves and on the lands can cause irreversible damage to the engine.

Typical lubricants used in internal combustion engines are designed to retard deposit formation but not to remove the carbon buildup that has accumulated over time. This is especially relevant in modern internal combustion engines where additional performance demands have increased piston temperatures.

Further, lubricants for internal combustion engines must be compatible with elastomers such as seals in the engine, have acceptable corrosion resistance, be adequate in cleaning the engine and not exhibit excessive oil consumption. In order to be used in diesel engines the formulated lubricant must have enough detergency and dispersancy to pass the multiple engine tests required for the particular manufacturer's specification and/or the requirements of the specification of the American Petroleum Institute "C" or "F" category for diesel engine oils or likewise the ACEA (European Automobile Manufacturers Association) diesel categories. Yet the ash containing components necessary to pass these demanding specifications typically exacerbate deposits. Thus although it is possible to produce an engine oil with a low tendency to form deposits using conventional high aniline point base oils (e.g. some oils used in natural gas engines) it will typically not pass specifications for use with diesel engines. Furthermore, such an oil outside the range of solvency proscribed herein does not have the effect of cleaning and freeing piston rings thereby reducing oil consumption or preventing loss of oil consumption.

SUMMARY OF THE INVENTION

The present invention is premised on the realization that a lubricant formulation can act to prevent and/or remove carbon buildup in an internal combustion engine.

In particular, a lubricant formulation formed from a blend of base oils with a defined solvency of the base oil, a volatility below a defined threshold (15% as measured by NOACK), a minimum oxidative stability (above 40 minutes as measured by PDSC) and a base oil viscosity of from about 2 to about 10 cSt can effectively prevent the carbon buildup and remove carbon buildup. The solvency can be measured by various methods, such as, for example, aniline point. Lubricant formulations with a base oil blend having an aniline point of 20-115 and preferably 60, should adequately remove carbon buildup in engines and still exhibit elastomer compatibility.

The base oil formulation is formed by blending Group III and/or Group IV lubricants with higher solvency base oil from Group V in relative amounts to establish the effective solvency, volatility, oxidative stability and base oil viscosity, while remaining compatible with elastomers, providing acceptable corrosion prevention and cleaning of the engine without excessive oil consumption.

The objects and advantages of the present invention will be further appreciated in light of the following detailed description and brief description of the figures.

DETAILED DESCRIPTION OF THE INVENTION

The lubricant of the present invention includes a base oil blend, which is a mixture of different base stocks in combination with typical additives normally found in lubricant formulations used for internal combustion engines. The base oil, which is a blend of two or more types of base oils, is blended together to establish a solvency which is adequate to control/remove the carbon deposits. In the present invention, solvency can be defined in various manners. One way of defining solvency is the aniline point. The aniline point is the minimum equilibrium solution temperature for equal volumes of aniline and a sample. In this case, the sample would be the base oil blend. It should be noted that when specifying the range of aniline point for the desired base oil blend it is understood that up to 25% of the formula may consist of other additives. Additives are frequently carried in up to 50% base oil. Thus, all base oil in the formulation, including base oil added with the additive, should have an aniline point as specified hereinafter.

The specific testing method for aniline point is set forth in ASTM D 611. For use in the present application, the aniline point is defined in terms of degrees Celsius. For use in the present invention, the base oil should have a solvency equivalent to an aniline point of 20-115. However, the solvency cannot be so great as to make the base oil incompatible with elastomers. Generally, a solvency defined by aniline point of 50 to 95 or 55 to 80 has been found to be effective for use in the present invention, particularly about 60.

Figure 1:
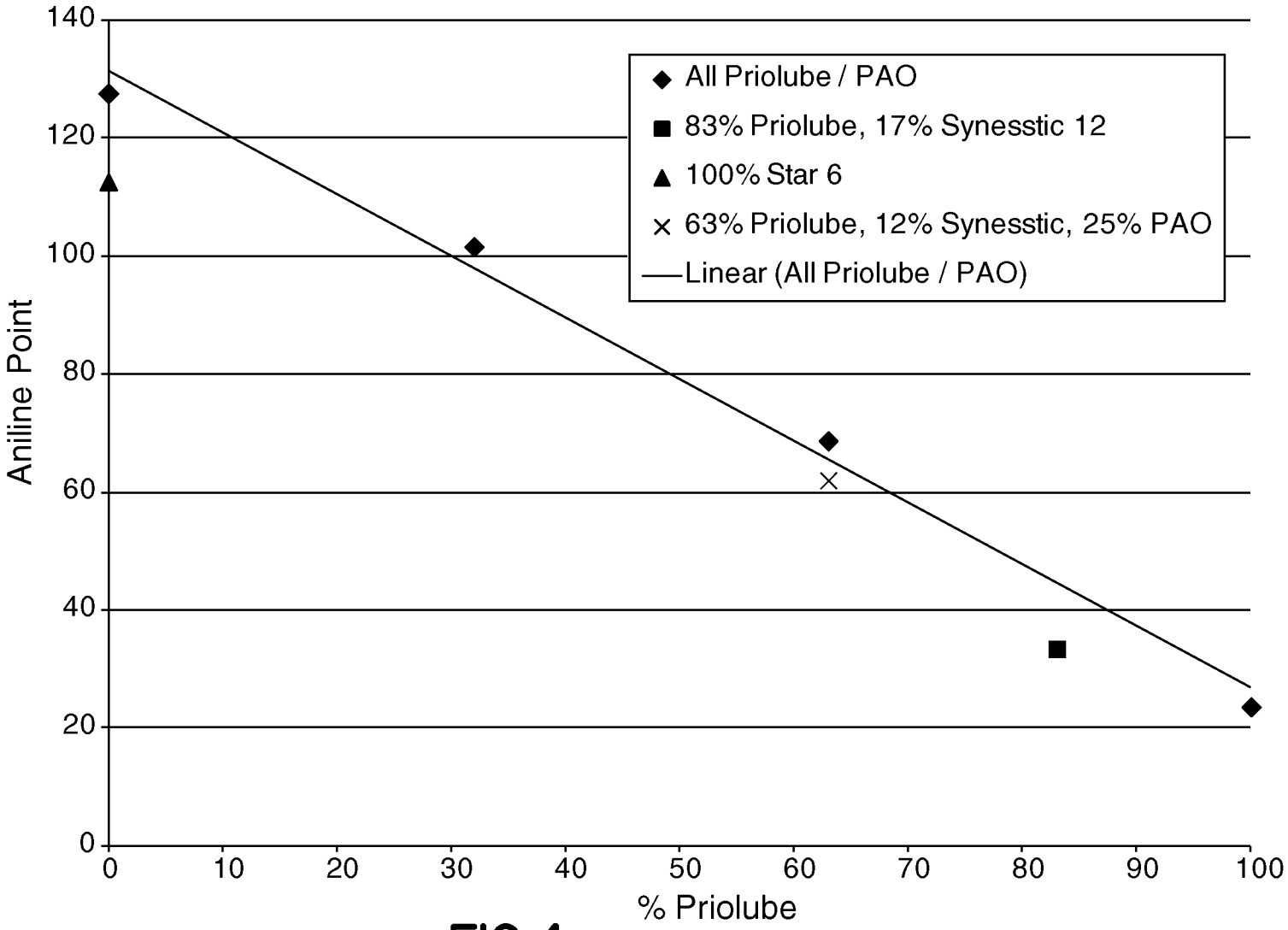
FIG. 1 is a graph showing aniline points of various fully-formulated lubricant formulations as a function of Group V percentage of the base oil mixture.
Figure 2:
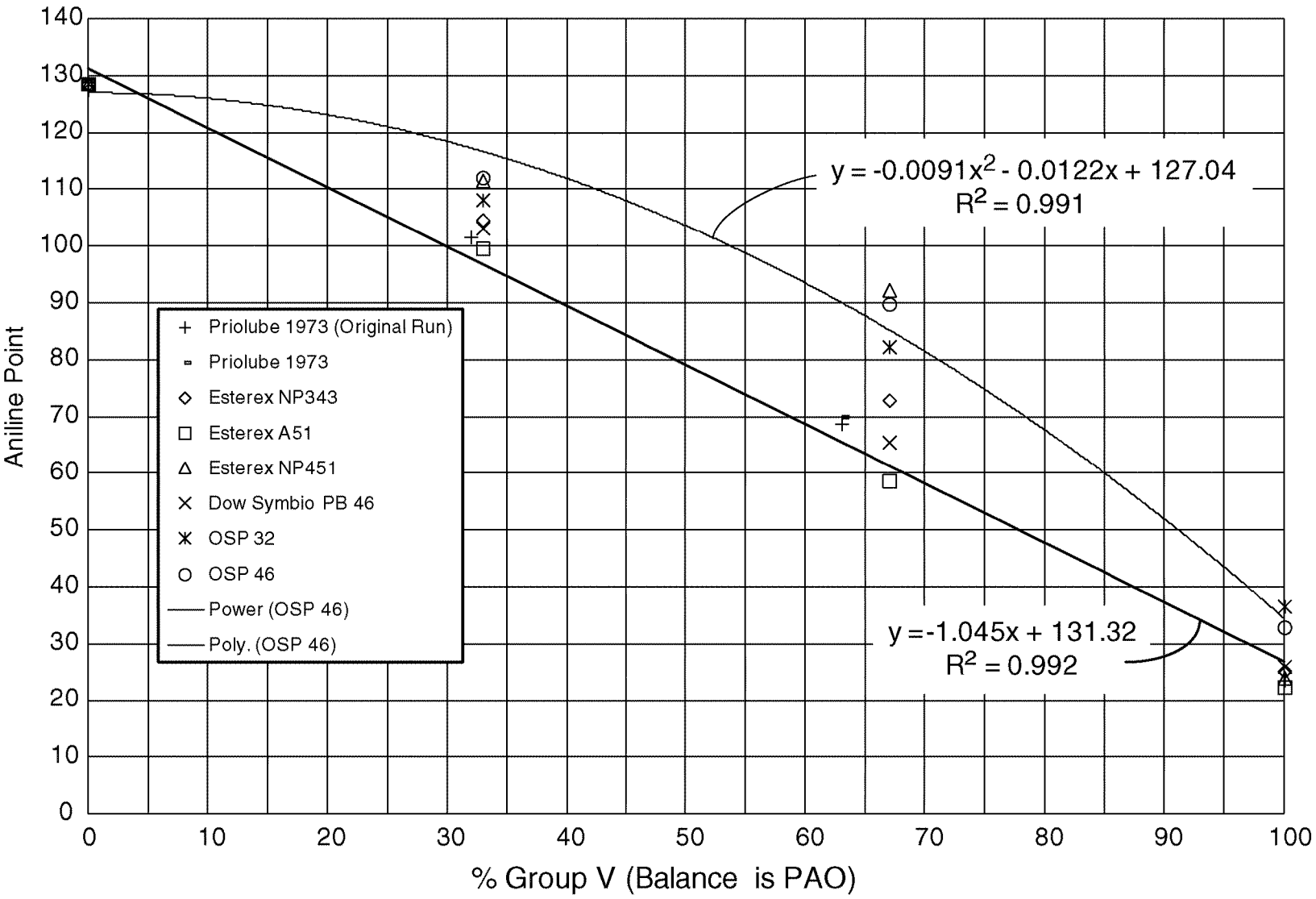
FIG. 2 is a graph showing aniline points of fully-formulated lubricants blended with PAO as a function of Group V percentage of the base oil mixture.
Figure 3:
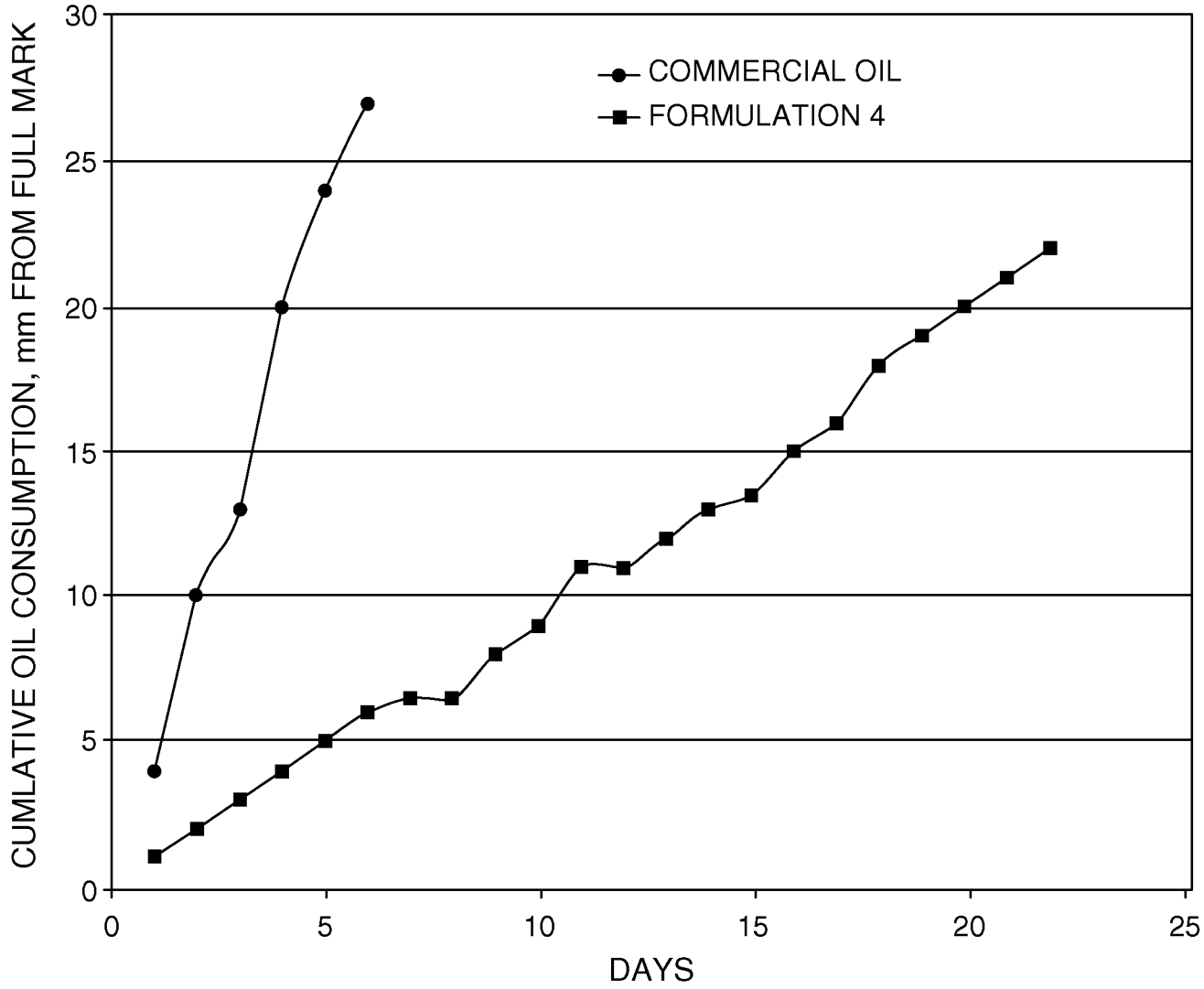
FIG. 3 is a graph comparing oil consumption of a commercially-available oil versus an oil of the present invention.

The Group III and/or Group IV base oils combine with Group V base oils to form a base oil with the desired aniline point. This is demonstrated by the data shown in FIG. 1, which shows various combinations of base oils and their aniline points. FIG. 2 shows aniline point data from combinations of Group V base oils and PAO.

Volatility is also critical for effectively lubricating an engine. Generally, for use in the present invention, the volatility as measured by NOACK must be less than 15% and preferably less than 10% and generally 8% or less. This is controlled by optimizing the balance of Group III, IV, and V, base oils.

In addition, to volatility, the formulated oil must exhibit acceptable oxidative stability. As measured by pressure differential scanning calorimetry ASTM D6186 PDSC (the data in this application was obtained using PDSC with compressed air rather than compressed oxygen), the formulated oil should have a minimum of 40 minutes and preferably above 80 or even 100 minutes. Selection of appropriate base stocks promotes this, in particular, base stocks from Group V.

Preferably, the base oil will have a viscosity index greater than 120, preferably greater than 135 and more preferably 150 or higher.

Finally, the base oil viscosity, as measured by D445, should be below 10 centistokes, preferably below 8 and above about 2 centistokes. Again, selection of the appropriate base oil will define the viscosity.

Further, the formulated oil should have a Thermo-oxidation Engine Oil Simulation Test of 33 (ASTM D6335) below 20 mg. A deposit rating in this test of less than 20 mg total deposit is viewed as necessary along with the other criteria, such as the aniline point and other parameters aforementioned for good performance.

The lubricant formulation of the present invention will generally be formed from a blend of base oils from at least two of the Groups III, IV and V. Group III, Group IV and Group V base oils in the present invention refer to the definitions of American Petroleum Institute for Categories III, IV and V. Group IV base oils primarily include polyalphaolefin base oils (PAO). Preferred polyalphaolefin base oils may be used in the present invention may be derived from linear $C_2$ to $C_{32}$, preferably $C_6$ to $C_{16}$ alphaolefins. Particularly preferred feed stocks for the alphaolefins are 1-octene, 1-decene, 1-dodecene and 1-tetradecene.

Group III base oils suitable for forming the base oil blend of the present invention include, for example, GTL (gas to liquid) base stocks, as well as base stocks formed under severe hydroprocessing that meet Sulfur, Saturates content and Viscosity Index requirement of API Group III category.

Generally, any Group V base oil that can reduce the aniline point of the base oil and is suitable for use in internal combustion engines can be employed in the present invention. It should be noted that low viscosity index base oils such as naphthenes and aromatic extracts would increase solvency but are unsuitable for use in engine oils due to their poor oxidative stability.

Suitable Group V base oils include alkylated aromatic compounds, polyalkylene glycols and ester base oils and mixtures thereof. One preferred alkylated aromatic compound is an alkylated naphthalene. The alkylated naphthalenes are naphthalenes substituted with one or more short chain alkyl groups, such as methyl ethyl or propyl. Exemplary alkyl substituted naphthalenes include alpha methylnaphthalene, dimethylnaphthalene and ethylnaphthalene. Synesstic is a commercially-available alkylated naphthalene.

Group V ester base oils include but are not limited to unsaturated esters, polyesters including estolides and diesters. Other Group V lubricants which can be used in place of, or in addition to, esters include polyalkylene glycols, as well as novel synthetic base stocks under Group V category providing solvency, volatility and anti oxidation benefits.

Specific suitable ester lubricants for use in the present invention include saturated polyol esters commercially available from Croda International, PLC, under the name Priolube 1973. Other suitable esters for use in the present invention include those available from Oleon under the name Radialube, those available from Chemtura under the name of Hatcol, those available from BASF under the name of Cognis Synative, those available from Emery under the name Emery, and those available from Exxon Mobile under the name Esterex. Generally these are esters formed by the reaction of a $C_5$-$C_{25}$ acid with a $C_5$-$C_{24}$ diol.

In selecting the particular components for the base oil as measured by ASTM 2270, if one were to choose a more polar polyol ester, the amount of the polyol ester would need to be reduced in order to maintain compatibility with elastomers in the engine. In other words, if the solvency, as defined by aniline point or other measures of solvency, is too great (the aniline point is too low), the seals in the engine could be destroyed by the lubricant formulation and begin leaking, also corrosion might occur prematurely. Any base oil blend that passes the seals test ASTM-D7216 can be used.

Also, in order to improve fuel economy, it is desirable for the low aniline point Group V base oil, that is the polar portion of the base oil, to have higher viscosity than the paraffinic molecule, such as the PAO, generally 4-5 cSt higher.

In one embodiment according to the present invention, the lubricant formulation includes an ester-based oil, an alkylated naphthalene and a PAO. The PAO provides lubricity and oxidative stability, but contributes little if any solvency. Group III base oils can be used in place of the PAO. The alkylated naphthalene provides oxidative stability, contributes to solvency and contributes to the requisite viscosity. Preferably polyol esters improve the solvency of the base oil mixture. These esters, together, with the alkylated naphthalene, would be added in amounts effective to establish the solvency with the aniline point at between 20 and 115 and preferably between 50 and 95. As shown in FIG. 1, a formulation with 20%, preferably 30%, polyol ester with the remainder PAO has a favorable aniline point. The upper limit of polyol ester is determined by other performance characteristics and will generally not exceed 80%.

In one embodiment, the lubricant formulation can include 40-60% polyol ester, 5-15% alkylated naphthalene and 15-25% PAO, in particular about 50% of the polyol ester, in particular Priolube 1973, 10% of an alkylated naphthalene and 20% PAO.

Generally, the formulation will include lubricant additives typically found in automotive and diesel engine applications referred to as the additive package. These can include, but are not limited to oxidation inhibitors, dispersants, metallic and non-metallic detergents, corrosion and rust inhibitors such as borate esters, metal deactivators, anti-wear agents, extreme pressure additives, pour point depressants, viscosity modifiers, seal compatibility agents, friction modifiers, defoamants, demulsifiers and others. An ashless TBN(acid neutralizer) can be added in an amount of oil to 2% by weight.

Table I shows four exemplary formulations and physical data.

TABLE I

| OIL COMPONENTS | | #1 | #2 | #3 | #4 |
|---|---|---|---|---|---|
| Base Oil #1 | Lubrigreen SE7B | 50.00 | 0.00 | | |
| Base Oil #2 | Elevance 1119-159 | 0.00 | 50.00 | | |
| Base Oil #3 | Priolube 1973 | | | 30 | 50 |
| Base Oil #4 | Synesstic 12 | | | 10 | 10 |
| Base Oil #5 | PAO 6 | 26.95 | 26.95 | 35.75 | 14.95 |
| Base Oil #6 | PAO 4 | | | 2.5 | 5 |
| VI Improver 2 | | | | | |
| Viscosity Index (VI) Improver 1 | SV 265 | 3.00 | 3.00 | | |
| Additive Package 1 | D3495L | 19.30 | 19.30 | | 19.3 |
| Additive Package 2 | LZ CV9601 | | | 21 | |
| Corrosion Inhibitor | Borate Ester Mix (PX 3871) | 0.20 | 0.20 | 0.20 | 0.20 |
| Antioxidant | Irganox L67 | 0.50 | 0.50 | 0.50 | 0.50 |
| Antifoam | Chemaloy F-655 | 0.05 | 0.05 | 0.05 | 0.05 |
| | Total | 100.00 | 100.00 | 100.00 | 100.00 |
| LAB TEST RESULTS | KV100 cSt | 11.36 | 12.21 | 11.95 | 12.05 |
| | KV40 | 65.91 | 71.57 | 79.35 | 79.46 |
| | VI | 169 | 171 | 145 | 147 |
| | CCS@−25 C. | 3622 | 5329 | 6490 | 6820 |
| | MRV@−30 C. | 29279 | | 12750 | 14134 |
| | Pour Point | −33 C. | −42 C. | −48.00 | −45 |
| | PDSC Oxidation (min) | | | 76.22 | 102 |
| | Noack Volatility % | 5.83 | 7.63 | 7.14 | 5.4 |
| | Base Oil Blend Aniline Point | 67 | 66 | | 62 |
| | Base Oil Blend KV100 cSt | 6.23 | 5.89 | 6.93 | 7.26 |
| | Total Deposit (mg) | | | | 5.7 |

In using the formulation of the present invention to free piston rings and remove previously built-up carbon deposits on engine pistons, the oil in the engine is drained and replaced with a formulation having significant solvency, such as one with an aniline point of about 60. The engine is run until the oil needs to be replaced again, which typically is at least 30,000 miles of operation for the diesel engine and 5000 miles for gasoline engine in a vehicle. Once the oil needs to be replaced, it can be replaced with standard engine oil formulation. The benefit of this oil drain is determined by comparing oil consumption in the engine before and after the drain. In field tests improved oil consumption (reduced oil consumption) was found of up to 179% in Class 8 trucks and up to 275% in stationary engine testing of Class 8 engines with previously high deposits and high oil consumption.

FIG. 2 shows a comparison of oil consumption using a commercially-available oil and Formulation 4 in Table I. Oil consumption is generally related to engine deposit formation. The data in FIG. 2 demonstrates reduced oil consumption as a result of using the oil of the present invention.

A formulation with a solvency as defined by an aniline point of approximately 90 is effective at preventing carbon buildup and is simply used continuously throughout the life of the engine, obviously being replaced with new lubricant at timed intervals, as required by the engine manufacturer. One such formulation is formulation #3.

Additional formulations are shown in Table II.

TABLE II

| | | #5 | #6 | #7 | #8 | #9 | #10 | #11 | #12 | #13 | #14 | #15 | #16 | #17 |
|---|---|---|---|---|---|---|---|---|---|---|---|---|---|---|
| Base Oil #1 | Lubrigreen SE7B | | | | | | | | | | 68.9 | | | |
| Base Oil #2 | Elevance 1119-159 | | | | | | | | | | | 32.3 | | |
| Base Oil #3 | Priolube 1973 | | | | | 70.5 | | | | | | | | |
| Base Oil #4 | Synesstic 12 | | | | | | | | | | | | | |
| Base Oil #5 | PAO 6 | 57.9 | 42.4 | 36.3 | 31.9 | 10.2 | 80.7 | 39.65 | 39.65 | 22.3 | 11.8 | 48.4 | 40.35 | 40.35 |
| Base Oil #6 | PAO 4 | | | | | | | | | | | | | |
| Base Oil #7 | Esterex NP343 | 22.8 | | | | | | | | | | | | |
| Base Oil #8 | Esterex A51 | | 38.3 | | | | | | | | | | | |
| Base Oil #9 | Esterex NP 451 | | | 44.4 | | | | | | | | | | |
| Base Oil #10 | Dow Symbio PB 46 | | | | 48.8 | | | | | | | | | |
| Base Oil #11 | OSP 32 | | | | | | | 40.35 | | | | | | |
| Base Oil #12 | OSP 46 | | | | | | | | 40.35 | | | | | |
| Base Oil #13 | Hatcol 2352 | | | | | | | | | 58.4 | | | | |
| Base Oil #14 | Hatcol 2926 | | | | | | | | | | | | 40.35 | |
| Base Oil #15 | Hatcol 2999 | | | | | | | | | | | | | 40.35 |
| VI Improver 2 | | | | | | | | | | | | | | |
| Additive Package 1 | D3495L | 19.3 | 19.3 | 19.3 | 19.3 | 19.3 | 19.3 | 19.3 | 19.3 | 19.3 | 19.3 | 19.3 | 19.3 | 19.3 |
| Borate ester mix | | | | | | | | 0.2 | 0.2 | | | | | |
| Irganox L67 | | | | | | | | 0.5 | 0.5 | | | | | |

TABLE II-continued

| | | #5 | #6 | #7 | #8 | #9 | #10 | #11 | #12 | #13 | #14 | #15 | #16 | #17 |
|---|---|---|---|---|---|---|---|---|---|---|---|---|---|---|
| LAB TEST RESULTS | KV100 cSt | | | | | | | | | 9.42 | 11.07 | 9.93 | 11.13 | 12.34 |
| | KV40 | | | | | | | | | 57.91 | 57.91 | 58.33 | 72.63 | 79.64 |
| | PDSC Oxidation (min) | 75.29 | | 86.83 | 63.14 | 55.5 | | 51.73 | 51.34 | | | | | |
| | Noack Volatility % | 5.26 | | 6 | 7.85 | 4.62 | | | | 4.6 | 6.34 | | 5 | 5 |
| | Base Oil Blend Aniline Point | 110 | | 100 | 70 | 40 | 128 | | | 70 | 50 | 90 | 113.6 | 96 |
| | TEOST 33 Rod Deposit (mg) | 14.1 | 19.3 | 11.7 | 6.8 | 3.4 | | | | 16.2 | 4.6 | 9.9 | 5.7 | 3.4 |
| | Filter Deposit (mg) | 1.3 | 0.4 | 0.4 | 1.5 | 0.6 | | | | 1.3 | 1.9 | 4.4 | 1.5 | 0.9 |
| | Total Deposit (mg) | 15.4 | 19.7 | 12.1 | 8.3 | 4 | 35.4 | | | 17.5 | 6.5 | 14.3 | 7.2 | 4.3 |

The formulation of the present invention is useful in preventing and/or removing carbon deposits on engine pistons, and maintaining and/or freeing up piston rings. Yet, at the same time, the formulation meets requisite elastomeric compatibility, oil consumption, cleanliness and corrosion requirements for the engine.

This has been a description of the present invention, along with the preferred method of practicing the invention, wherein the invention itself should be defined only by the appended claims wherein we claim:

What is claimed is:

1. A lubricant formulation having an oxidative stability (as measured by PDSC) above 51 minutes and a volatility (as measured by NOACK) of less than 15%; said formulation including a base oil blend formed from Groups III or IV, or a mixture of the two, and an amount of Group V base oil having a solvency of the base oil blend as defined by aniline point of from 20° C. to 95° C. and a viscosity at 100° C. (as measured by ASTM D445) of from about 2 to about 10 cSt, wherein said lubricant formulation includes at least about 35% of said Group V base oil, wherein a viscosity at 100° C. (as measured by ASTM D445) of each polyalphaolefin base oil in said base oil blend is about 6 cSt or less, and wherein said lubricant formulation includes a metal-containing additive, said additive providing a zinc content of about 735 ppm or higher.

2. The formulation of claim 1, wherein said base oil blend includes a polyalphaolefin, and a Group V base oil of higher viscosity than the polyalphaolefin.

3. The formulation of claim 1 having an additive package including a borate ester.

4. The formulation of claim 2 wherein the Group V base oil is a polar ester wherein the viscosity of the polar ester is greater than 5 cSt.

5. The formulation of claim 1 having the viscosity index of the base oil mix composition greater than 120 by ASTM method 2270.

6. The formulation of claim 5 having a viscosity index greater than 150.

7. The formulation of claim 1 including an ashless TBN (acid neutralizer) in the range of 0.1 to 2% of the final composition.

8. The formulation of claim 1, comprising a base oil blend of polyalphaolefin, alkylated naphthalene and polyol ester.

9. The formulation of claim 2, wherein said Group V base oil includes an oil selected from the group consisting of polyol esters, diesters, polyalkylene glycols, estolides and combinations thereof.

10. The formulation of claim 1 having a volatility of less than 10% and a TEOST 33 less than 20 mg.

11. The formulation of claim 10 having a base oil blend with 20% to about 80% by weight Group V and from about 80% to 20% by weight PAO.

12. The formulation of claim 10 wherein said base oil blend has an aniline point of 50-95° C.

13. The formulation of claim 12 having a PDSC of at least 100 minutes.

14. The formulation of claim 11 wherein said PAO has a first viscosity and said Group V base oil has a second viscosity and said second viscosity is greater than said first viscosity.

15. The formulation of claim 2, said base oil blend having an aniline point of at least 50° C.

16. The formulation of claim 1, said base oil blend having an aniline point of at least 55° C.

17. A lubricant formulation having an oxidative stability (as measured by PDSC) above 51 minutes and a volatility (as measured by NOACK) of less than 15%;

said formulation including a base oil blend formed from Groups III or IV, or a mixture of the two, and an amount of Group V base oil having a solvency of the base oil blend as defined by aniline point of from 20° C. to 95° C. and a viscosity at 100° C. (as measured by ASTM D445) of from about 2 to about 10 cSt, wherein said lubricant formulation includes at least about 35% of said Group V base oil, wherein each said Group V base oil has a higher viscosity than a paraffinic oil in said lubricant formulation, said paraffinic oil including each said Group IV base oil, and wherein said lubricant formulation includes a metal-containing additive, said additive providing a zinc content of about 735 ppm or higher.

18. The formulation of claim 17, comprising a base oil blend of polyalphaolefin, alkylated naphthalene and polyol ester.

19. The formulation of claim 17, wherein said Group V base oil includes an oil selected from the group consisting of polyol esters, diesters, polyalkylene glycols, estolides and combinations thereof.

20. The formulation of claim 17 having a volatility of less than 10% and a TEOST 33 less than 20 mg.

21. The formulation of claim 17 wherein said base oil blend has an aniline point of from 50 to 95° C.

22. The formulation of claim 1 having at least one of a detergent and a dispersant.

23. The formulation of claim 17 having at least one of a detergent and a dispersant.

* * * * *